US006299000B1

(12) United States Patent
Cabrera

(10) Patent No.: US 6,299,000 B1
(45) Date of Patent: Oct. 9, 2001

(54) GOLF CLUB CLEANING RACK

(76) Inventor: Luis H. Cabrera, 12929 Trailing Ivy La., Fulks Run, VA (US) 22830

( * ) Notice: Subject to any disclaimer, the term of this patent is extended or adjusted under 35 U.S.C. 154(b) by 0 days.

(21) Appl. No.: 09/593,388

(22) Filed: Jun. 14, 2000

(51) Int. Cl.[7] ..... A47F 5/00

(52) U.S. Cl. ..... 211/70.2; 211/70.6; 211/89.01; 211/104

(58) Field of Search ..... 211/70.2, 68, 89.01, 211/65, 66, 104, 70.6

(56) References Cited

U.S. PATENT DOCUMENTS 2,621,799 * 12/1952 Wilson .
2,737,990 3/1956 De Marco .
4,037,765 * 7/1977 Slayman .
4,821,358 4/1989 Wyckoff et al. .
4,965,906 10/1990 Mauro .
5,155,883 10/1992 Legault .
5,213,364 5/1993 Theckston .
5,560,066 10/1996 McDivitt .
5,687,979 * 11/1997 Plevka .
5,829,604 * 11/1998 Brophy ..... 211/70.2
5,940,918 8/1999 Binette .
6,032,999 3/2000 York et al. .

* cited by examiner

*Primary Examiner*—Robert W. Gibson, Jr.
(74) *Attorney, Agent, or Firm*—Richard C. Litman

(57) ABSTRACT

A multiple golf club cleaning aid device for mounting the clubs vertically, adapted to be mounted on a wall of a car wash establishment and the like, and foldable for portage.

7 Claims, 1 Drawing Sheet

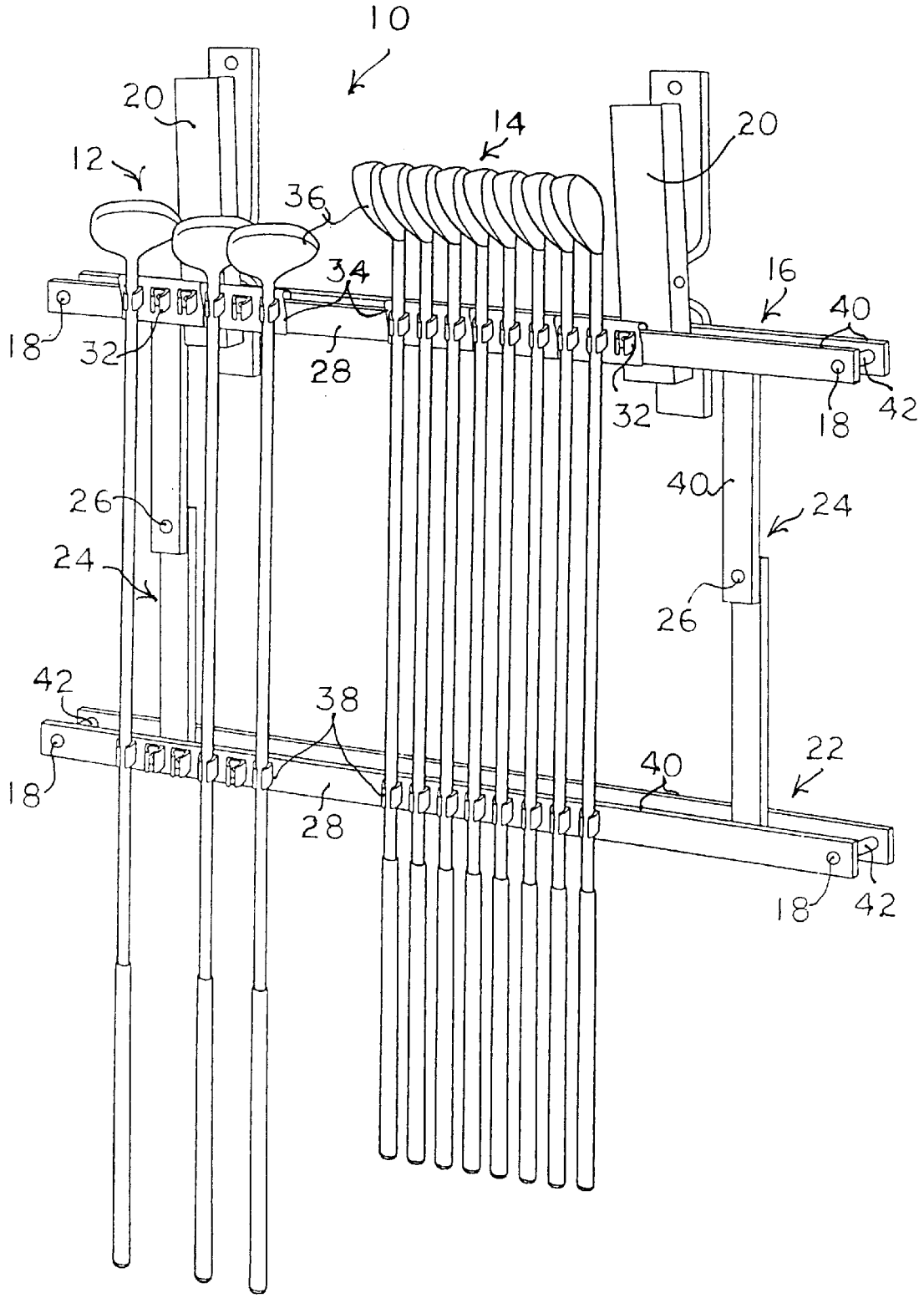
10
20
14
20
12
36
34
16
40
18
32
28
32
18
42
40
26
24
24
26
42
38
22
40
18
28
18
42

GOLF CLUB CLEANING RACK

BACKGROUND OF THE INVENTION

1. Field of the Invention

The present invention relates generally to cleaning aid devices. More specifically, the invention is a cleaning rack for mounting and cleaning golf clubs in a car wash establishment or the like.

2. Description of the Related Art

The related art of interest describes various golf ball or club head cleaning devices, but none discloses the cleaning rack for a car wash establishment. There is a need for an efficient and quick washing apparatus utilizing the power washing available in a car wash establishment. The relevant art will be discussed in the order of perceived relevance to the present invention.

U.S. Pat. No. 2,737,990 issued on Mar. 13, 1956, to Joseph J. De Marco describes a golf club mounted and golf ball carrier having an aluminum tubing frame and a bottom spike for driving into the ground for play and carrying the clubs and balls by the fabric sleeved top cross arm. The clubs are mounted horizontally in pairs by spring clamps on the side arms. The device is distinguishable for its spiked frame structure.

U.S. Pat. No. 5,213,364 issued on May 25, 1993, to Dana L. Theckston describes a golf club holder and dispenser device mounted on the rear of a golf cart. A housing contains a rotating motorized frame with notches to hold the clubs accessible by a transparent cover on top. Some clubs are held by brackets on the rear of the housing. Two drawers are added below the housing. The housing device is distinguishable for its motorized club holding frame.

U.S. Pat. No. 6,032,999 issued on Mar. 7, 2000, to Michael T. York et al. describes a golf club and accessory carrier having a top handle connecting two Christmas tree shaped ends having clips for holding clubs on its sides. A lower frame holds golf balls. The thin portion of the sides above the feet has clips for tees. The carrier is distinguishable for having a Christmas tree configuration for holding golf clubs horizontally.

U.S. Pat. No. 4,821,358 issued on Apr. 18, 1989, to Charles W. Wychoff et al. describes a golf club head cleaner device for mounting on posts or to a golf cart comprising an upright cylindrical housing with a removable top cover having an elongated slot for insertion of an iron club head. Two opposing brush blocks are held inside with cleaning fluid, and the club head is moved vertically for cleaning. The device is distinguishable for its limitation to cleaning only one club head at a time.

U.S. Pat. No. 4,965,906 issued on Oct. 30, 1990, to Edward Mauro describes a combination golf ball and club head cleaning device mountable on a post or a golf cart. A housing has two compartments for separately and manually cleaning golf balls and club heads. Each compartment contains brushes and aqueous cleaning solutions. The device is distinguishable for cleaning only single club heads.

U.S. Pat. No. 5,155,883 issued on Oct. 20, 1993, to Raymond L. Legault describes a combination golf club head and ball washer device comprising a box with an external crank handle rotating two brushes by gearing in counter rotation. The box contains an aqueous detergent solution. The lid has a tubular member for inserting golf balls. The lid can be tilted up for insertion of a club head for cleaning. The device can be attached to a vertical wall. The device is distinguishable for its individual washing of club heads and golf balls in a box with a crank driving two brushes and containing a cleaning solution.

U.S. Pat. No. 5,560,066 issued on Oct. 1, 1996, to Mark W. McDivitt describes a portable golf club head cleaning device having a rotatable brush and recirculating pump powered by a power supply. The device is distinguishable for its required motorized brush cleaning of golf club heads.

U.S. Pat. No. 5,940,918 issued on Aug. 24, 1999, to Marc R. Binette describes an apparatus for cleaning a golf club head comprising a housing having a top with separate openings for right and left handed club heads for brushing by an external crank handle. No cleaning solution is involved. The apparatus is distinguishable for its dry brushing of a single club head.

None of the above inventions and patents, taken either singularly or in combination, is seen to describe the instant invention as claimed. Thus, a multiple golf club cleaning aid solving the aforementioned problems is desired.

SUMMARY OF THE INVENTION

Basically, the instant invention is a multiple golf club cleaning aid device, configured so as to mount the clubs vertically, adapted to be mounted on a wall of a car wash establishment or other similar facility, and foldable for portage.

Accordingly, it is a principal object of the invention to provide a multiple golf club cleaning rack.

It is another object of the invention to provide a multiple golf club cleaning rack which can be hung vertically on a wall.

It is a further object of the invention to provide a multiple golf club cleaning rack which can be hung vertically on a wall of a car wash stall.

Still another object of the invention is to provide a multiple golf club cleaning rack which can be hung vertically on a wall of a car wash stall for cleaning by power washing.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The sole FIGURE is an environmental, perspective view of a multiple golf club cleaning rack with clubs clamped on a wall.

DETAILED DESCRIPTION OF THE PREFERRED EMBODIMENT

The present invention describes a multiple golf club cleaning rack 10 for mounting on a wall of a car wash establishment. The golf clubs are conveniently arranged vertically in groups such as the "woods" 12 and the "irons" 14 which differ in shaft lengths and club head sizes. The rack 10 comprises a first horizontal set of two parallel bars 16 at a first height connected by fasteners 18 at each end to leave a space between them for clamping by the wall clamps 20 conveniently provided in some car wash establishments for cleaning car mats and rugs by using pressurized hot and soapy water.

A second horizontal set of two spaced parallel bars 22 connected by fasteners 18 at each end is positioned below the first set of bars 16. The parallel bars are connected proximate their ends by vertically oriented crossbars 24 which are hinged at a midpoint 26 in order to conveniently fold or collapse the rack 10 for portage or storage.

Each front bar 28 of the first and second sets of parallel bars 16, 22, respectively, has brackets for holding the golf clubs 12, 14. A pair of clamps 20 are usually positioned on a car wash wall for washing car rugs or mats by soap and a powered hot water hose. Therefore, the rack 10 can be conveniently held by the available wall clamps 20 for cleaning the arrayed clubs with a power wash. There is a distinct and unexpected advantage for holding the clubs 12, 14 in a vertical position, because one does not have to stoop to clean the sides of the club heads if placed in a horizontal manner.

The upper golf club holding brackets 32 are mounted on a continuous plastic clamp 34 that projects the golf club heads 36 slightly forward. The upper brackets 32 and corresponding lower brackets 38 are conveniently divided into two sets for the "wood" drivers 12 and for the "iron" clubs 14. The rack 10 is made of aluminum strips 40 except for the club holding brackets 32 and 38 which are made of flexible rubber or plastic material.

Each end of the first and second horizontal sets of bars 16 and 22 are separated by fasteners 16 which are covered with plastic tubing 42.

It should be noted that the rack 10 can be mounted on a homeowner's garage wall for cleaning the clubs with a hose and brush.

It is to be understood that the present invention is not limited to the embodiment described above, but encompasses any and all embodiments within the scope of the following claims.

I claim:

1. A multiple golf club cleaning aid rack for cleaning clubs, said rack comprising:

a first horizontal set of two parallel bars including a front bar and a rear bar connected by fasteners at each end thereof to leave a space between them;

a second horizontal set of two parallel bars including a front bar and a rear bar connected by fasteners at each end thereof to leave a space between them;

said first horizontal set of bars being spaced above said second horizontal set of bars, said first and second horizontal sets of parallel bars being connected proximate their ends by vertically oriented crossbars;

each said front bar of said first and second sets of parallel bars includes an plurality of upper brackets and a corresponding plurality of lower brackets for holding vertically arranged golf clubs; and a pair of clamps positioned on a wall for supporting said rack while cleaning the golf clubs with a power wash.

2. The multiple golf club cleaning aid rack according to claim 1, wherein the upper brackets are mounted on a continuous clamp for projecting the golf club heads forward.

3. The multiple golf club cleaning aid rack according to claim 1, wherein the upper brackets and the corresponding lower brackets are divided into two sets for the "wood" drivers and for the "iron" clubs.

4. The multiple golf club cleaning aid rack according to claim 1, wherein the vertically oriented crossbars are adapted to collapse sideways by hinges at a midpoint for folding the rack.

5. The multiple golf club cleaning aid rack according to claim 1, wherein the rack is made of aluminum strips except for the club holding brackets.

6. The multiple golf club cleaning aid rack according to claim 1, wherein the club holding brackets are made of flexible rubber or plastic material.

7. The multiple golf club cleaning aid rack according to claim 1, wherein each end of the first and second horizontal sets of bars are separated by fasteners covered with plastic tubing.

* * * * *